US005211217A

United States Patent [19]

Morii et al.

[11] Patent Number: 5,211,217

[45] Date of Patent: May 18, 1993

[54] VERTICAL CONTINUOUS CASTING METHOD AND CASTING APPARATUS

[75] Inventors: Kiyoshi Morii, Kohnan; Shuzo Kumura, Aichi; Shyzunori Hayakawa, Tokai; Yoshio Inagaki, Aichi, all of Japan

[73] Assignee: Diado Tokushuko Kabushiki Kaisha, Nagoya, Japan

[21] Appl. No.: 953,198

[22] Filed: Sep. 29, 1992

Related U.S. Application Data

[63] Continuation of Ser. No. 798,982, Nov. 19, 1991, abandoned, which is a continuation of Ser. No. 567,988, Aug. 16, 1990, abandoned.

[30] Foreign Application Priority Data

Aug. 16, 1989 [JP] Japan ..... 1-211067
Jun. 25, 1990 [JP] Japan ..... 2-164256

[51] Int. Cl.[5] ..... B22D 11/00
[52] U.S. Cl. ..... 164/476; 164/417
[58] Field of Search ..... 164/476, 417, 451, 452, 164/454, 150, 154, 413

[56] References Cited

FOREIGN PATENT DOCUMENTS 62-148065 7/1987 Japan ..... 164/476
63-313643 12/1988 Japan ..... 164/154
1-91946 4/1989 Japan ..... 164/476

*Primary Examiner*—Kuang Y. Lin
*Attorney, Agent, or Firm*—Varndell Legal Group

[57] ABSTRACT

Disclosed are a method and an apparatus for vertical continuous casting. The vertical continuous casting includes drawing a strand formed in a watercooled mold vertically downward therefrom, positioning light reduction pinch rollers just prior to the solidification completing point of the strand, and applying a light reduction force to the strand sufficient to compensate for contraction caused by solidification of the strand. By this procedure the formation of central cavities is prevented and central segregation is lessened. The light reduction pinch rollers are arranged to be adjustably positioned up and down along the strand, in order to compensate for fluctuations in the location of the solidification completing point of the strand.

4 Claims, 5 Drawing Sheets

VERTICAL CONTINUOUS CASTING METHOD AND CASTING APPARATUS

This application is a continuation of Ser. No. 07/798,982, filed Nov. 29, 1991, which is a continuation application of Ser. No. 07/567,988, filed Aug. 16, 1990, both now abandoned.

BACKGROUND OF THE INVENTION

1. Field of the Invention

This invention relates to improvements in vertical continuous casting or the casting technique of obtaining cast pieces by drawing a strand formed in a water-cooled mold downward without incurvating, and then cutting the strand.

2. State of the Art

Nowadays, the continuous casting process holds an important position in a steel casting. However, the horizontal continuous casting process is somewhat problematical from a technical point of view. For such reasons it has only been tried in part. Accordingly, the curved and vertical continuous casting processes are overwhelmingly used today. The vertical continuous casting is disadvantageous because it requires equipment which has a high cost. Accordingly, the curved continuous casting process is predominately used. In this process a strand is incurvated (a water-cooled mold is structured so as to provide the curved strand) to extend horizontally, thereby keeping a height of the casting equipment within a certain limit. The strand extending horizontally is rectified to be straight with pinch rolls and cut with a frame cutter into cast pieces.

However, such a process comprising curved casting and horizontal rectification is not necessarily preferable for some special kinds of steel with respect to producing castings of sufficient quality. For example, the rectification operation often causes cracks on the strands of valve steel, high-speed steel and other steels. Accordingly, this kind of steel will have to be casted by the vertical continuous casting wherein a strand is formed without curvature in the water-cooled mold, drawn straightly downward and cut to cast pieces.

In the vertical continuous casting process, light reduction should be applied to the strand coming out of the water-cooled mold at a position immediately before an unsolidified portion disappears in the interior of the strand, whereby contraction of the strand due to solidification is compensated, and thus, formation of cavities at the center of the strand may be prevented, and center segregation is lessened as well. In this way cast pieces of better quality can be obtained.

However, in the case of some steels for which the application of light reduction is effective, different kinds of steels are usually produced in relatively small quantities. Therefore, the sectional size and the pertinent drawing speed of a strand varies. For such reasons, the optimal position at which the light reduction is to be applied, namely, the point at which the unsolidified portion of the strand disappears can vary from one strand to another.

SUMMARY OF THE INVENTION

The object of this invention is to provide a method and apparatus for vertical continuous casting wherein a light reduction is applied to a strand at an optimal position at all times while compensating for frequently fluctuating casting conditions, enabling the production of cast pieces having superior quality.

BRIEF DESCRIPTION OF THE DRAWINGS

FIG. 3 to FIG. 5 are detailed drawings exemplifying a mechanism for adjusting the position along the strand for applying the light reduction means in the apparatus of FIG. 2; wherein FIG. 3 is a side view, FIG. 4 is a sectional view taken on line I—I of FIG. 3, and FIG. 5 is a sectional view taken on line II—II of FIG. 3.

DETAILED EXPLANATION OF PREFERRED EMBODIMENTS

Figure 1:
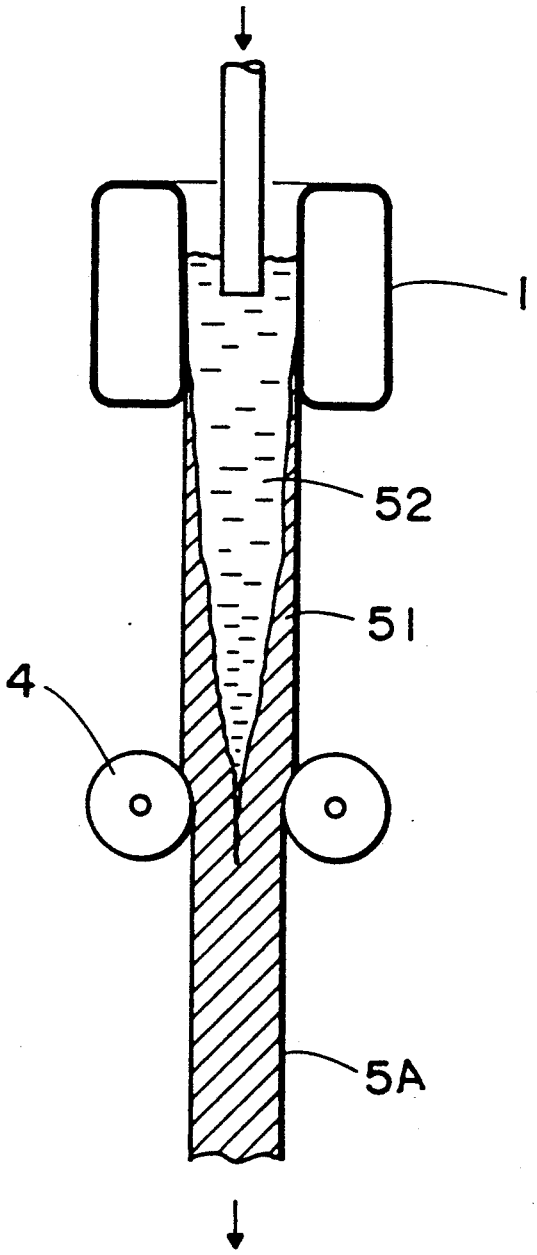
FIG. 1 is a longitudinal sectional view showing a state of strand interior and a position for light reduction in a continuous casting.

In a continuous casting method for drawing a strand formed in a water-cooled mold vertically, the method of the present invention comprises, as shown in FIG. 1, positioning light reduction means (4), or pinch rolls representatively, just prior to a solidification completing point of a strand (5A) or a point at which an unsolidified portion (52) within a shell (51) disappears. The light reduction is applied to the strand in an amount sufficient to compensate for contraction caused by solidification of the strand.

Figure 2:
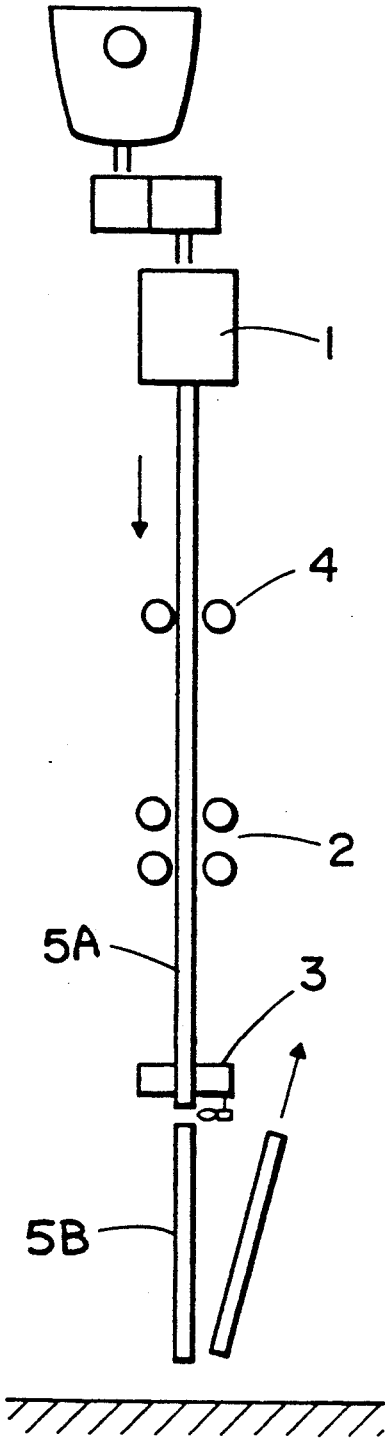
FIG. 2 is a conceptional side view showing a principal part for general construction of a vertical continuous casting apparatus according to this invention.

A vertical continuous casting apparatus comprising, as shown in FIG. 2, includes a water-cooled mold (1) and its ancillary equipment, drawing drive rolls (2) and a strand cutter (3) provided below the water-cooled mold. The apparatus is also provided with means (not illustrated) for feeding a molten metal to the water-cooled mold. The apparatus of the present invention additionally comprises providing light reduction means (4) which can be adjustably positioned upward or downward along the strand relative to the water-cooled mold so as to apply light reduction to the strand strong enough to compensate for contraction due to solidification of the strand just before the solidification completing point of the strand. A reference character (5B) denotes a cast piece obtained from cutting the strand, which will be carried away by a separate device one by one. A device (10) can be included for detecting the solidification completing point and the location of the light reduction means can be adjusted based thereon.

Figure 3:
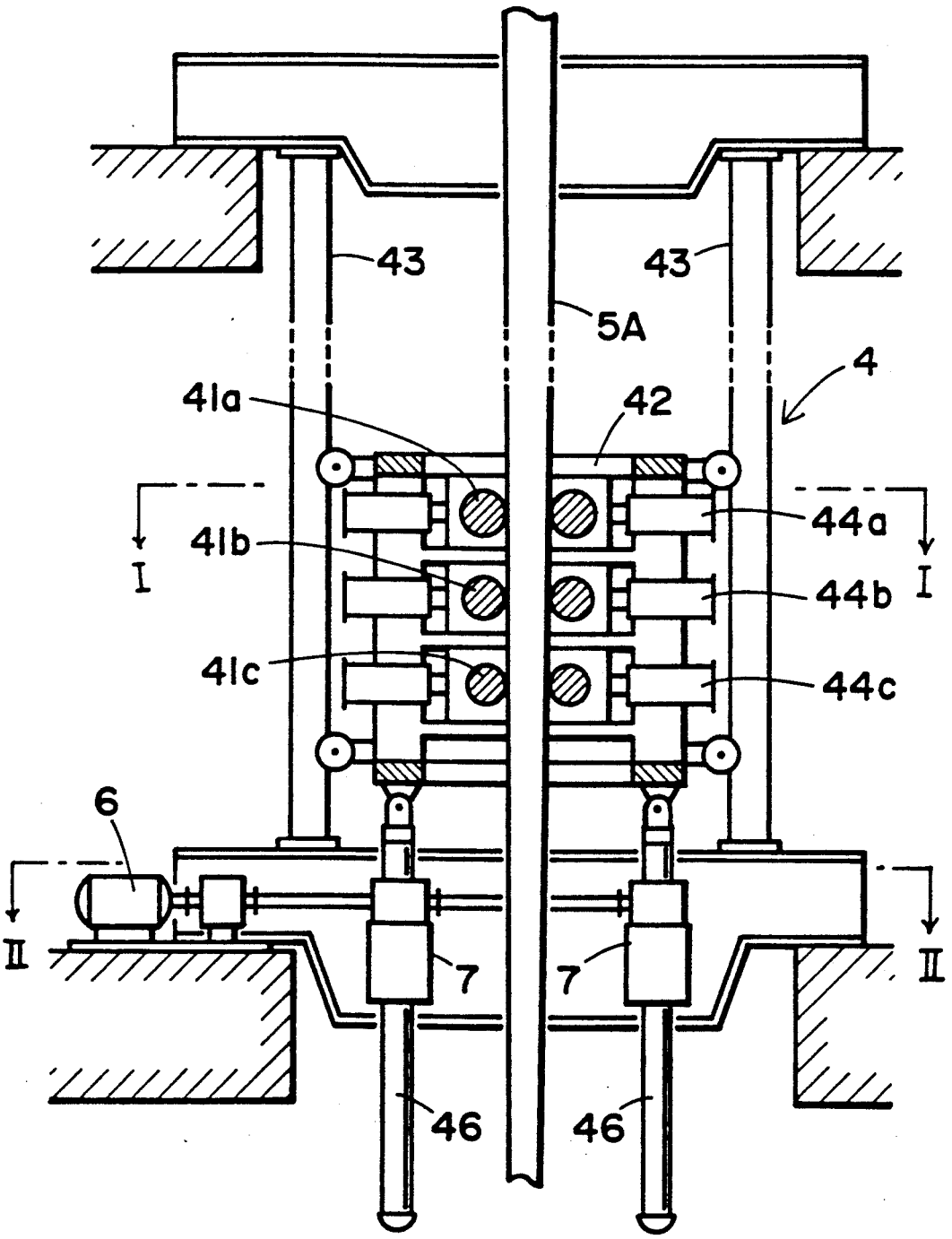
Figure 4:
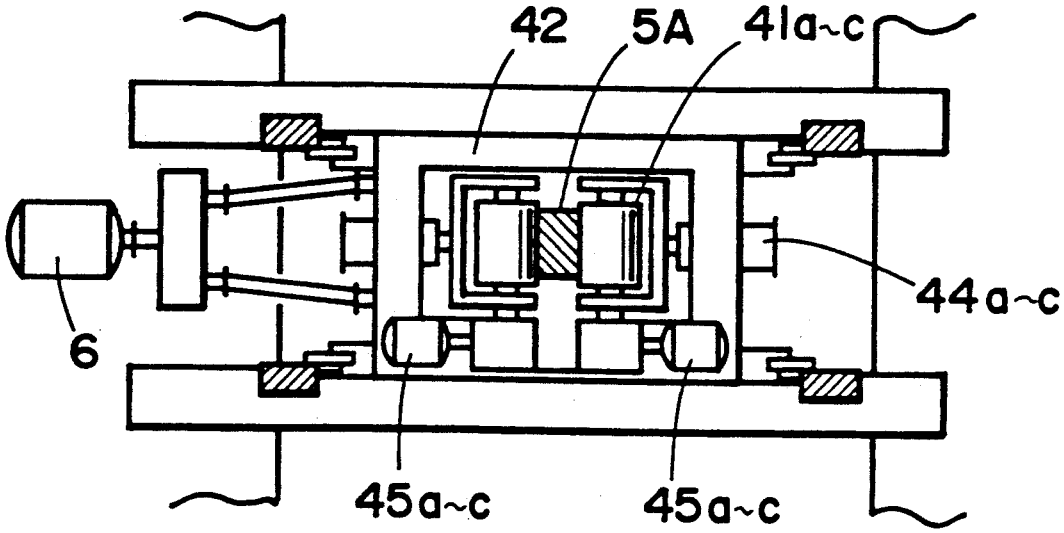
Figure 5:
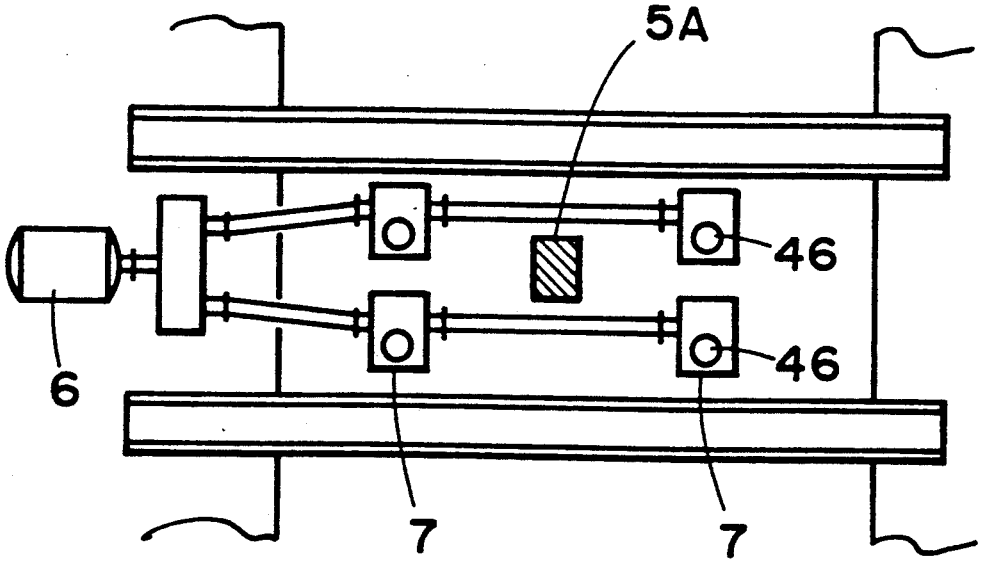

The light reduction means and a technique for providing it variably in position along the strand are arbitrary, however, the devices shown in FIG. 3 to FIG. 5 will be exemplified as typical. The device can be constructed such that three pairs of pinch rolls (41*a*, 41*b*, 41*c*) are mounted on a frame 42, and the frame (42) is made movable vertically along four pieces of vertical guide columns (43). Each pinch roll is mounted slidably on the frame to advance and retreat by hydraulic cylinders (44*a*, 44*b*, 44*c*) fixed on the frame to pinch the strand (5A) from opposite sides, driven by motors (45*a*, 45*b*, 45*c*), and is capable of applying a desired light reduction force on the strand metal.

As shown in FIG. 5, the positions of the pinch rolls (41*a* to 41*c*) can be changed by worm-jack mechanisms (7) moving vertically from having four pieces of vertical bars (46) on a lower portion of the frame (42) rotated according to rotations of a motor (6) and male screws of the vertical bars engaged with fixed female screws.

Figure 6:
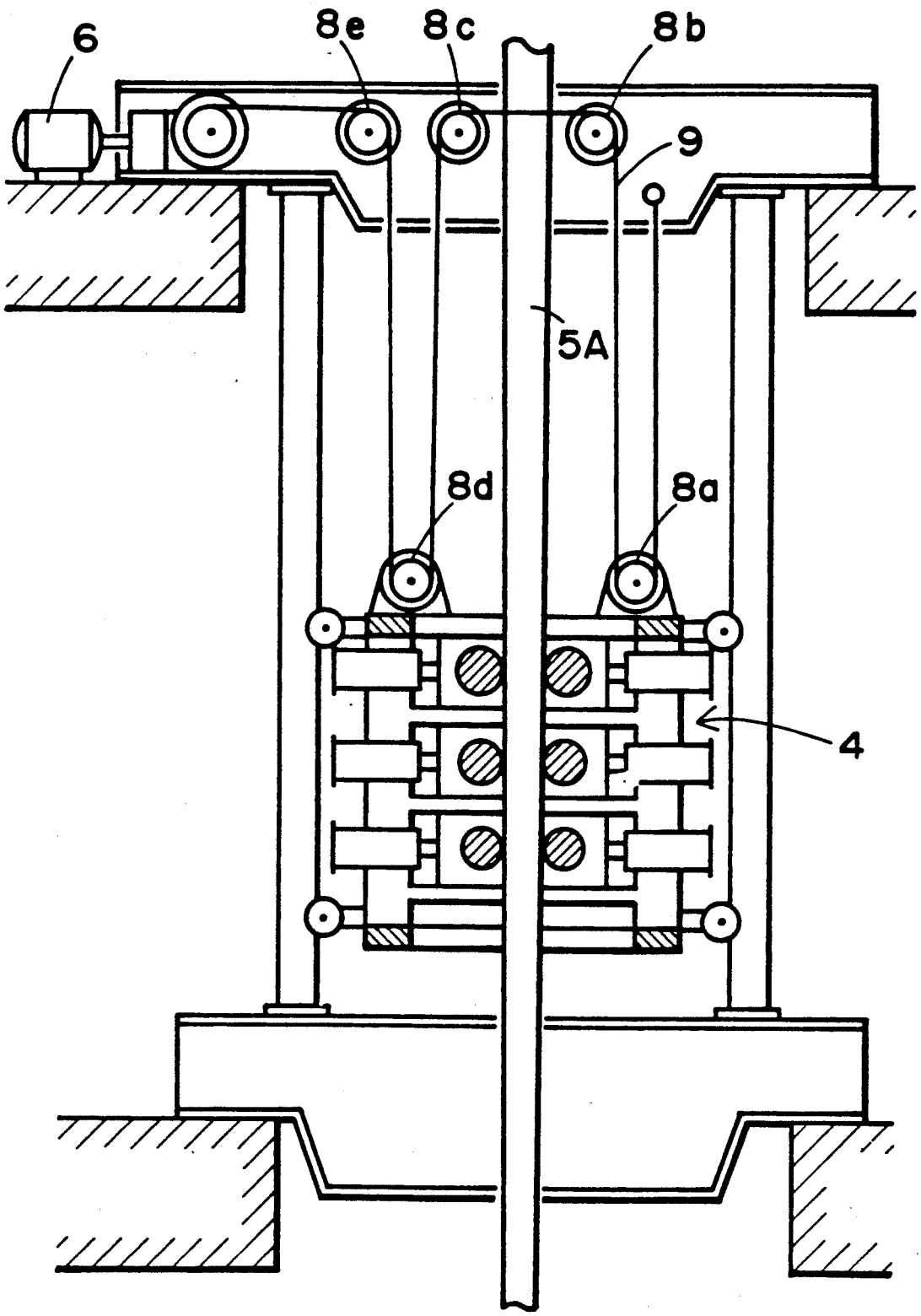
FIG. 6 is a side view similar to FIG. 3, representing another example of the mechanism for adjusting the position of the light reduction means along the strand in the apparatus of FIG. 2.

FIG. 6 indicates another mode of providing the light reduction means variably in position along the strand. In this apparatus, a construction of the light reduction means, namely, the frame and the pinch rolls fitted thereon and other parts are the same as the example described above, however, what is different is that a vertical movement of the frame is realized by winding and unwinding a wire (9) about pulleys (8*a*, 8*b*, 8*c*, 8*d* and 8*e*).

Operation

The position of the light reduction means can be moved up and down along the axis of the strand, and is adjusted to apply a light reduction at the solidification completing point of the strand based on conditions such as the kind of steel to be subjected to the continuous casting, sectional size of a strand, drawing speed and others, and by carrying out a light reduction at an optimal position, advantages of the present invention can be achieved.

A determination of the solidification completing point can be made, for example, as follows. That is, since a thickness (D) of the shell (51) of a strand coming out of the water-cooled mold increases, as a time (t) passes, in the relation:

$$D = k\sqrt{t}$$

a value of k is determined on a technique wherein a spike is driven, for example, in the strand and then a cast metal is cut to determine whether or not an unsolidified portion is present at the position, and thus the solidification completing point in the strand can be estimated according to the above equation.

Recently, a technique has been established for detecting a solidification completing point by utilizing the phenomenon that the propagation speed of ultrasonic wave varies in solid and liquid. It is therefore preferable that a device for detecting a solid/liquid interface on an ultrasonic wave is added to the light reduction means (4). In this way a solidification completing point for the strand can be found for positioning the light reduction means when starting the operation, the light reduction can be performed precisely; and when the solidification completing point fluctuates according to changes in the kind steel to be subjected to the continuous casting and in casting conditions, the change in the solidification point is determined and the position of the light reduction means is modified.

The strand is drawn by the aforementioned drawing drive rolls, therefore it is not required for the light reduction pinch rolls to have a driving force. However, the light reduction pinch rolls can be utilized advantageously for inserting dummy bars into the water-cooled mold when starting the casting operation. The object is attained by providing a driving function to the light reduction pinch rolls, therefore, the aforementioned apparatus is provided with a driving motor.

According to this invention, a light reduction can be applied to a strand just prior to a solidification completing point in casting a special steel vertically and continuously by adjusting the location of the light reduction along the strand to an optimal position always corresponding to the strand sectional size and changes in casting conditions. Thus, a quality product can be obtained for the special steels by preventing the occurrence of center cavities, lessening of center segregation and so forth.

We claim:

1. A continuous casting method comprising:
   casting a molten strand of metal from a water-cooled mold,
   drawing said strand vertically downward from said mold,
   positioning a light reduction means about the strand,
   determining a solidification completing point of the strand,
   moving the light reduction means along an axis of the strand in a vertical direction to a point slightly above said solidification completing point, and
   applying a light reduction force to said strand by said light reduction means sufficient to compensate for contraction caused by solidification of said strand.

2. A vertical continuous casting apparatus comprising:
   water-cooled mold means for providing a molten strand of metal,
   drawing drive rollers for vertically drawing said strand downward arranged below said mold means,
   a strand cutter for cutting said strand after solidification thereof arranged below said drawing drive rollers,
   light reduction means, arranged below said mold means and above said drawing driver rollers and continuously and vertically movable along an axis of said strand, for applying a force to said strand to compensate for contraction caused by solidification thereof at a position along said strand slightly prior to a solidification completing point of said strand, and
   means for periodically detecting said solidification completing point by ultrasonic waves and for adjusting said position of said light reduction means relative to changes in said solidification completing point along said axis of said strand.

3. The vertical casting apparatus according to claim 2, including a frame housing said light reduction means and vertical guide columns slidably receiving said frame, and said light reduction means includes at least a pair of pinch rollers driven by hydraulic cylinders for pinching the strand from opposite sides thereof.

4. The vertical continuous casting process according to claim 3, wherein said pinch rollers of said light reduction means are arranged for providing a drive function to said apparatus and serving as dummy bar pinch rollers.

* * * * *